United States Patent [19]

Bellovary et al.

[11] 4,159,034

[45] Jun. 26, 1979

[54] WELDMENT HEAT EXCHANGER

[75] Inventors: Louis Bellovary; Andrew J. Cottone, both of Racine, Wis.

[73] Assignee: Modine Manufacturing Company, Racine, Wis.

[21] Appl. No.: 796,446

[22] Filed: May 12, 1977

[51] Int. Cl.[2] ..... F28F 9/18

[52] U.S. Cl. ..... 165/153; 165/175; 165/180; 165/DIG. 8; 228/183; 285/286

[58] Field of Search ..... 165/DIG. 8, 180, 67, 165/79, 149, 153, 134, 173, 175; 122/DIG. 13, DIG. 16; 228/183; 285/189, 286

[56] References Cited

U.S. PATENT DOCUMENTS

| | | | |
|---|---|---|---|
| 1,278,243 | 9/1918 | Sonneborn | 165/175 |
| 1,281,247 | 10/1918 | Winslow | 122/DIG. 16 |
| 1,320,652 | 11/1919 | Sonneborn | 122/DIG. 16 |
| 1,899,629 | 2/1933 | Morse | 165/149 |
| 1,990,752 | 2/1935 | Ragsdale | 165/148 |
| 2,085,677 | 6/1937 | Thayer | 165/72 |
| 2,434,988 | 1/1948 | Christensen | 165/149 |
| 2,937,855 | 5/1960 | Hazen | 165/134 |
| 3,257,710 | 6/1966 | Brown et al. | 165/134 |
| 3,540,529 | 11/1970 | Umino et al. | 165/134 |
| 3,960,210 | 6/1976 | Chartet | 165/149 |

FOREIGN PATENT DOCUMENTS

| | | | |
|---|---|---|---|
| 2180117 | 4/1973 | France | 165/DIG. 8 |

*Primary Examiner*—Sheldon J. Richter

*Attorney, Agent, or Firm*—Wegner, Stellman, McCord, Wiles & Wood

[57] ABSTRACT

A weldment heat exchanger having at least the surfaces contacted by the fluids between which heat is exchanged of stainless steel and comprising a tube bundle having spaced tubes through which one of the fluids flows and over the outer surfaces of which tubes a second fluid flows for exchange of heat between the fluids through the walls of the tubes, a first header-tank at one end of the bundle and a second header-tank at the opposite end of the bundle, the joints of the parts including those of the two header-tanks and the tubes being welded.

5 Claims, 5 Drawing Figures

23
31
10
22
17
15
11
16
13
14
24
12
3.
3.
2.
19
32
18
33
21
25
2.
34
35
26

20
17
19
15
18
19
21
13
25

15
19
28
18
27
13
29
18
28
19
34
21

28
11
5.
19
18
32
34
29
37
35
5.

17
19
32
34
34
35
35
36
36

WELDMENT HEAT EXCHANGER

BACKGROUND OF THE INVENTION

Heat exchangers such as automobile radiators and similar types employing tube bundles with header-tanks at each end and provisions for flowing one fluid through the interior of the exchangers and another fluid such as air over the outer surfaces have long been made of copper, aluminum, brass and other such relatively lightweight and weak metals and alloys. In such exchangers the joints between the parts have customarily been soldered or brazed. As a result of the soft metal and this type of joint it has been necessary to provide supporting structure for the weak exchangers such as a supporting framework in which an automobile radiator, for example, is mounted.

SUMMARY OF THE INVENTION

The heat exchanger of this invention, on the other hand, is constructed of stainless steel parts in which either the parts are solid stainless steel or steel with surface coatings of stainless which may be produced by procedures well known in the art such as those described in U.S. Pat. Nos. 3,093,556; 3,184,331 and many others of a similar nature. Although the heat exchanger of this invention is preferably made of chromium containing stainless, other types of strong yet corrosion resistant steels may of course be used including Monel and Inconel. These steels are all very strong and, in addition, the heat exchanger of this invention is a weldment structure in that all joints between the tubes and headers are welded and, in addition, this weldment heat exchanger includes vertical members of sufficient thickness and therefore strength to provide a self-supporting structure for the heat exchanger and any attachments thereto including oil coolers and the flexible conduits that provide liquid access to and from the tanks.

DESCRIPTION OF THE PREFERRED EMBODIMENT

In the illustrated embodiment the automobile radiator heat exchanger 10 comprises end vertical header-tank combinations 11 and 12 each comprising a header plate 13 and 14 that is integrally formed as a part of a tank 15 and 16 that describe in cross section a circle having a chord surface area that comprises the flat header plate 13 and 14 with the two header plates being substantially parallel to each other.

Figure 3:
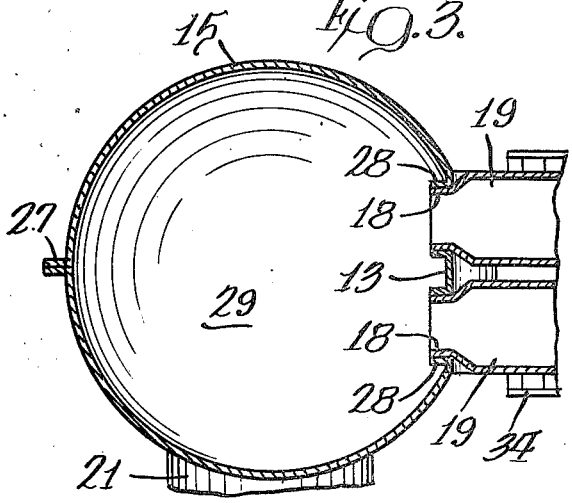

Extending between the vertical header-tanks 11 and 12 are parallel tubes 17 that together comprise a tube bundle. These tubes are of flattened cross section but with cylindrical ends 18 that extend into the respective plates 13 and 14 as shown most clearly in FIGS. 3 and 4. The flattened sections 19 which extend substantially the entire length of the tubes are parallel to each other and at right angles to the length of the tanks 15 and 16 so that cooling air can have better surface contact with these flattened areas.

Figure 1:
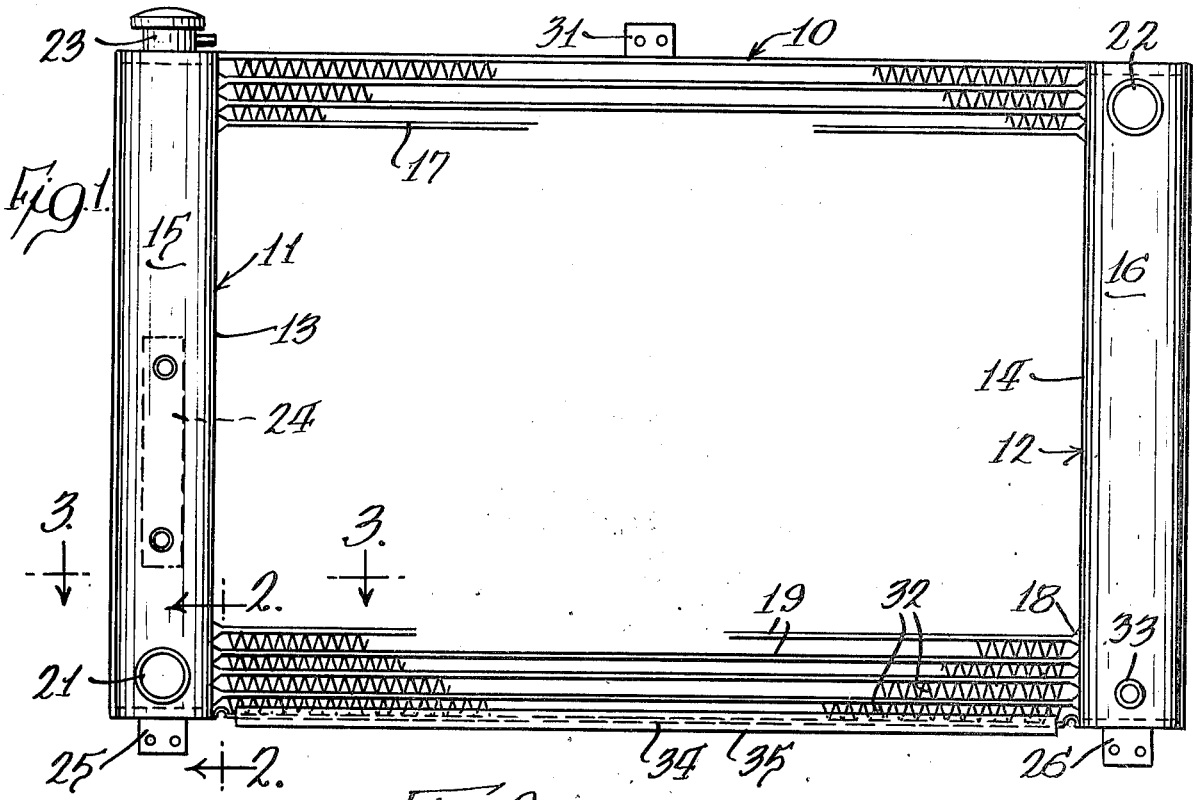
FIG. 1 is a side elevational view of a stainless steel heat exchanger of the nature of an automobile radiator embodying the invention.
Figure 2:
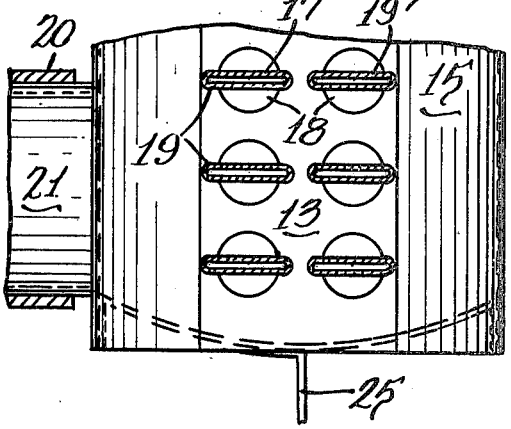
FIGS. 2 and 3 are each sectional views taken along the respective lines 2—2 and 3—3 of FIG. 1.

The header-tanks 11 and 12 comprise vertical members of sufficient thickness and thereby strength to provide a self-supporting structure for the heat exchanger and any attachments thereto such as the coolant hose 20 indicated in broken lines in FIG. 2. The tanks also have attached the usual coolant access fittings 21 and 22 and filler neck 23 as well as the internal oil cooler 24 in the tank 15 which may be of the type disclosed in U.S. Pat. No. 3,732,921 assigned to the assignee hereof.

The stainless steel parts of this heat exchanger which comprise the header-tanks 11 and 12 and the tubes 17 as well as the usual attachments 21–24 and bottom mounting flanges illustrated at 25 and 26 and top stabilizer bracket 31 are all welded together at the joints including the tank joints 27, tube and header joints 28 and end cap 29 joints 30. This welding may be any of the usual methods but preferably is by an inert gas-shielded electric arc that travels at high speed over the joints where the welding is to be produced thereby converting the metal to a molten state which when cooled comprises the joint. The welds are thereby made without the use of any added metal such as a welding rod and are protected from contamination by the inert gas shield, which inert gas may be argon. In this type of welding the only metal supplied is from the metal parts themselves at their contacting areas and the molten metal is protected by the inert gas. A high frequency high potential source is applied between the electrode and work piece and ionizes the gaseous medium, for example argon, surronding the electrode and the joint. Simultaneously a direct current of low potential is applied between the same electrode and the work piece comprising the heat exchanger parts. When the high potential high frequency source ionizes the gas an arc or stream of electrons caused by the presence of the direct current low potential source flows between the electrode 27 and the work thereby causing the welding work to be heated to the molten welding temperature at the joint. While the arc is flowing it establishes a magnetic field about itself which is acted upon by the transverse magnetic field produced usually by a solenoid coil thereby forcing the arc in a path that coincides with the configuration of the electrode, which also coincides with the configuration of the metal parts at the joint.

This speed of movement of the welding arc is proportional to the magnetic field strength and the arc current. In this method of shielded arc welding the electrode is not consumed and is preferably a tungsten electrode with a typical welding electrode being an alloy of 15 parts copper and 85 parts tungsten, both by weight. A specific embodiment of a welding apparatus employing these principles is described in the copending application of R. E. Stine Ser. No. 796,445, filed May 12, 1977 and assigned to the assignee hereof. The shielding prevents the formation of heavy oxide coating on the parts which the presence of the chromium in the stainless steel promotes.

As stated above, the preferred stainless steel is that which contains chromium in the amount of at least 12% such as from 12–32% although other types of stainless alloys may be used. Chromium containing stainless is preferred because the chromium is a strong promoter of hardenability as it decreases the critical cooling rate of steel and the chromium containing steel alloy has good creep particularly at high temperatures and pressures.

Because of the stainless steel weldment construction of the heat exchangers of this invention the exchanger is very strong and thus can be self-supporting. It can be mounted by the use of bottom flanges 25 and 26 and stabilizer bracket 31 without of necessity requiring an elaborate supporting frame as is customary now. For better heat transfer adjacent tubes may be provided if desired with the usual interconnecting serpentine fins 32. The bottom of the inlet tank 16 is also provided with the usual small drain 33.

The stainless steel parts are of sufficient thickness as to be quite strong and self-supporting. For example, tank-headers in one embodiment were constructed of stainless steel sheet 0.024 inch thick while the tube walls were of stainless steel 0.012 inch thick welded and annealed. The joints 28 were welded from the header side or the left side in FIG. 3 and then the longitudinal tank joint 27 was formed by welding the two ends of the tank 15 together. The welding process for joint 28 was the magnetically controlled arc welding.

Figure 4:
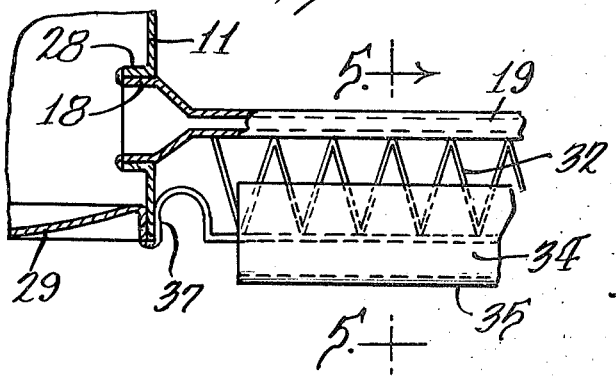
FIG. 4 is a fragmentary side elevational view taken substantially along line 4—4 of FIG. 2.
Figure 5:
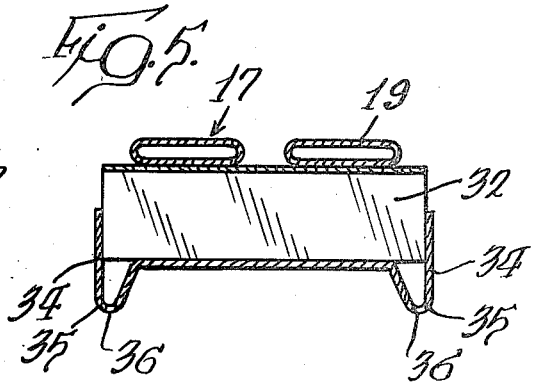
FIG. 5 is a detail sectional view taken substantially along line 5—5 of FIG. 4.

As shown in FIGS. 4 and 5 the radiator is provided with side members 34 at the bottom between the sides of which the first set of fins 32 extend and are in contact with the first set of tubes 17 at their flattened sections 19. These side members have edge wells 35 and in order to prevent condensation collecting the bottom of each well 35 is provided with drains 36. The side members 34 as shown in FIG. 4 have ends 37 welded to the header-tank 11 or 12 to which in turn the end caps 29 are welded.

This combination of parts of stainless steel is very simple to manufacture because the parts are welded together without requiring an added welding metal and, if desired, the assembly can be banded around the sides before and during welding so that no fixture is necessary to hold the parts in proper assembly.

Although the illustrated embodiment is to a cross flow radiator the invention is applicable to any heat exchanger such as a downflow radiator.

Having described our invention as related to the embodiment shown in the accompanying drawings, it is our intention that the invention be not limited by any of the details of description, unless otherwise specified, but rather be construed broadly within its spirit and scope as set out in the appended claims.

We claim:

1. A rigid, corrosion resistant weldment heat exchanger of joined stainless steel parts for exchanging heat between fluids, comprising: a tube bundle having spaced tubes with stainless steel inner and outer surfaces through which tubes one of said fluids flows and over the outer surface of which tubes a second said fluid flows for exchange of heat between the fluids through the walls of said tubes; a first header-tank at one end of said bundle also having inner and outer surfaces of stainless steel and communicating with the ends of the tubes of said bundle in fluid flow relationship; a second header-tank at the opposite end of said bundle also having inner and outer surfaces of stainless steel and communicating with the opposite end of the tubes of said bundle in fluid flow relationship; welds joining said parts together having as weld metal essentially only solid, previously molten metal from adjacent portions of said stainless steel parts; and heat exchange fins interconnecting adjacent said tubes over and between which fins said second fluid flows, said fins comprising aluminum fins attached to the outer surfaces of the corresponding tubes.

2. The weldment heat exchanger of claim 1 wherein said header-tanks and said tubes are substantially solid stainless steel.

3. The weldment heat exchanger of claim 1 wherein said header-tanks and said tubes have steel surfaces impregnated with a stainless alloying ingredient comprising chromium.

4. The weldment heat exchanger of claim 1 wherein said joined stainless steel parts comprise upwardly extending parts whose said rigidity provides self-support for said weldment heat exchanger.

5. The weldment heat exchanger of claim 4 wherein said upwardly extending parts are generally vertical and comprise stainless steel members having edges joined by said welds.

* * * * *